US008221086B2

(12) United States Patent
Watts

(10) Patent No.: US 8,221,086 B2
(45) Date of Patent: Jul. 17, 2012

(54) PROPELLER

(76) Inventor: Alan Edward Watts, Northants (GB)

( * ) Notice: Subject to any disclaimer, the term of this patent is extended or adjusted under 35 U.S.C. 154(b) by 72 days.

(21) Appl. No.: 12/133,982

(22) Filed: Jun. 5, 2008

(65) Prior Publication Data

US 2009/0010763 A1 Jan. 8, 2009

Related U.S. Application Data

(63) Continuation of application No. PCT/GB2006/004641, filed on Dec. 12, 2006.

(51) Int. Cl.
*B63H 1/26* (2006.01)

(52) U.S. Cl. ..... 416/234; 416/238; 416/242

(58) Field of Classification Search ..... 416/242, 416/243, 234, 238
See application file for complete search history.

(56) References Cited

U.S. PATENT DOCUMENTS

| | | | | | |
|---|---|---|---|---|---|
| 909,246 | A | * | 1/1909 | Spear | 416/242 |
| 1,473,066 | A | * | 11/1923 | Wells | 416/235 |
| 1,506,937 | A | * | 9/1924 | Miller | 416/228 |
| D137,473 | S | * | 3/1944 | Birsh | D12/214 |
| 2,638,171 | A | * | 5/1953 | Foss | 416/135 |
| 3,174,681 | A | | 3/1965 | Monroe | |
| 5,161,953 | A | | 11/1992 | Burtis | |
| 5,219,272 | A | * | 6/1993 | Steiner et al. | 416/139 |
| 5,226,804 | A | * | 7/1993 | Do | 416/238 |
| 6,164,919 | A | | 12/2000 | Vanmoor | |
| 6,699,016 | B1 | * | 3/2004 | Dean | 416/235 |

FOREIGN PATENT DOCUMENTS

| | | | |
|---|---|---|---|
| GB | 225811 | * | 5/1925 |
| GB | 2027132 | A | 2/1980 |
| GB | 2401916 | A | 11/2004 |

OTHER PUBLICATIONS

GB Search Report.
International Search Report and Written Opinion.

* cited by examiner

*Primary Examiner* — Edward Look
*Assistant Examiner* — Jesse Prager
(74) *Attorney, Agent, or Firm* — Brinks Hofer Gilson & Lione

(57) ABSTRACT

A propeller has a hub 1 with a pair of blades 3 extending therefrom. Each blade 3 has a root, a tip, a first blade portion 10*a* extending between the root and tip and a second blade portion 10*b* extending between the root and tip adjacent and substantially parallel to said first blade portion 10*a*. The first and second blade portions 10*a*, 10*b* each have an arcuate concave face 11*a*, 11*b*, the radius of curvature of the concave face 11*a* of said first blade section 10*a* being greater than the radius of curvature of the concave face 11*b* of the second blade section 10*b*. The concave faces of said first and second portions 10*a*, 10*b* facing in substantially opposite directions such that, in use, said concave face 11*a* of said first blade portion 10*a* faces rearwards and said concave face 11*b* of the second blade portion 10*b* faces forwards.

16 Claims, 10 Drawing Sheets

PROPELLER

CROSS-REFERENCE TO RELATED APPLICATIONS

Figure 1A:
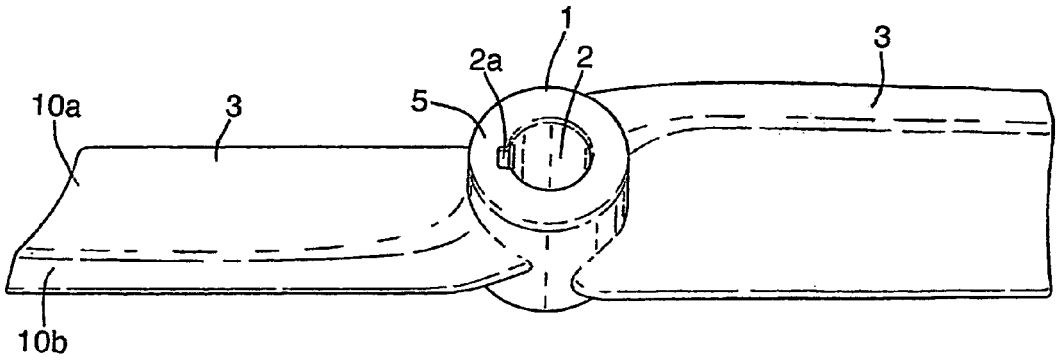

This application is a continuation of International Application No. PCT/GB2006/004641 filed on Dec. 12, 2006, which claims the benefit of 05261821.1 GB, filed Dec. 22, 2005. The disclosures of the above applications are incorporated herein by reference.

FIELD OF THE INVENTION

The present invention relates to propellers and in particular although not exclusively to water or marine propellers

BACKGROUND OF THE INVENTION

The statements in this section merely provide background information related to the present disclosure and may not constitute prior art.

A propeller operates by generating a thrust to drive a body, such as an aircraft or boat, by applying a force to the fluid in which it operates in order to change the momentum of the fluid in the direction opposite to that in which it is desired to drive the body. Each blade of the propeller, screw etc. is inclined to the desired direction of thrust, so that, as it rotates through the fluid, the normal reaction force has a component parallel to the direction of drive, the orientation being set to ensure that this force tends to push the fluid in a direction opposite to the desired direction of travel. Under Newton's first law, action and reaction are equal and opposite, and hence the fluid applies an equal and opposite force to the screw, propeller, etc. which reaction force is transmitted to the body and in turn drives the body through the fluid.

Conventional screw design is based on the works of Archimedes (c. 250 BC) and was later modified by Francis Petit Smith, and a typical such marine screw comprises a number of blades, normally 2 to 4, which are fixed to a hub either with their longitudinal axis perpendicular to the axis of the hub or inclined thereto towards the back of the craft on which the propeller is attached so as to produce aft rake. The blades are attached to the hub in a symmetrical pattern and each blade typically has a curved outer profile, normally formed by ogival or aerofoil sections, tapers outwardly from root to tip and twist from root to tip so that the tip of the blade has a greater angle of attack to the incident fluid than the root.

This conventional configuration has, however, a number of disadvantages. The shape of the blades tends to generate lift, and the resulting pressure differences can lead to early cavitation. Also, the twist or skew on a typical blade, which results in a variation in pitch along the blade, makes the propeller more complicated and hence more expensive to produce. Whilst attempts have been made over the years to reduce the impact of these drawbacks and also to improve efficiency, reduce cavitation etc of propellers, any improvements that have been achieved have been relatively small, and involved minor variations in blade shape, twist, size and taper without changing the underlying design of the marine screw.

British patent application no. 0411155.5 discloses a propeller blade design comprising a first blade portion having an arcuate cross section and being in the form of a longitudinal segment of a hollow truncated cone defined between two planes which extend longitudinally of the cone, are inclined to each other and which each intersect each other along the longitudinal axis of the cone, and a second blade section which extends adjacent the first blade portion, which is of similar shape to the first blade section with the radius of curvature of the two blade portions being the same at each point along the blade, and the first and second portions being arranged side by side facing opposite directions so as to form a sigmoid cross section.

SUMMARY OF THE INVENTION

According to the present disclosure, there is provided a propeller comprising a hub having a plurality of blades extending therefrom, each blade having a root, a tip, a first blade portion extending between said root and said tip and a second blade portion extending between said root and said tip adjacent and substantially parallel to said first blade portion, said first and second blade portions each having an arcuate concave face, the radius of curvature of the concave face of said first blade portion being greater than the radius of curvature of the concave face of the second blade portion, said concave faces of said first and second portions facing in substantially opposite directions such that, in use, said concave face of said first blade portion faces rearwards and said concave face of the second blade portion faces forwards.

A propeller in accordance with the disclosure has the advantage that it is effective across the maximum blade area, thereby improving efficiency, whilst the smaller radius of curvature on the concave face of the second blade portion, which faces forwards and hence operates to provide reverse drive to the craft, reduces the load on the engine and hence increases the life of the engine driving the propeller.

In one form, the radius of curvature of each concave face is substantially constant between the root and tip of the blade. However, in another form, the radius of curvature of each said concave face may decrease towards the root of the blade so as to form a conical concave surface. The blade may optionally twist between root and tip in order to increase efficiency, however it is preferred that each blade is untwisted.

Each of said plurality of blades of the propeller are, in one form, longitudinally aligned with each other on the hub, but in an alternative form, the blades may be longitudinally offset along the hub.

Due to the difference in the radius of curvature of the two blade portions, the angle subtended by the concave face of the second blade portion is, in one form, smaller than the angle subtended by the concave face of the first blade portion. For example, in one form, the face of the first blade portion forms an approximate 60 degree arc whilst the face of the second blade portion forms an approximate 45 degree arc.

Further areas of applicability will become apparent from the description provided herein. It should be understood that the description and specific examples are intended for purposes of illustration only and are not intended to limit the scope of the present disclosure.

In order that the disclosure may be well understood, there will now be described an embodiment thereof, given by way of example, reference being made to the accompanying drawings, in which:

DRAWINGS

The drawings described herein are for illustration purposes only and are not intended to limit the scope of the present disclosure in any way.

Figure 1B:
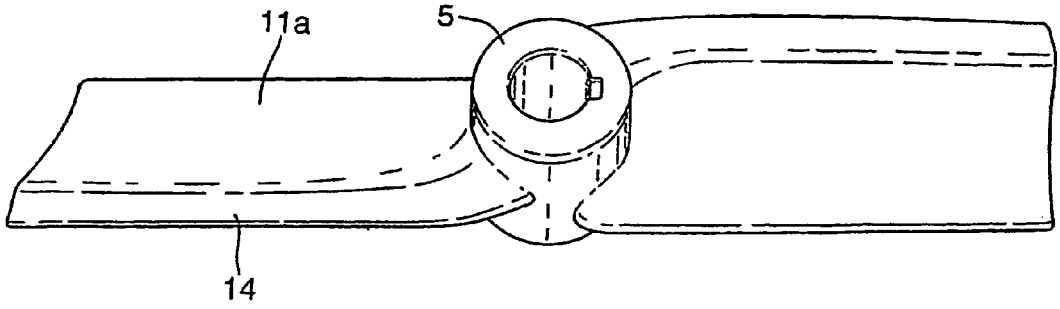
Figure 2:
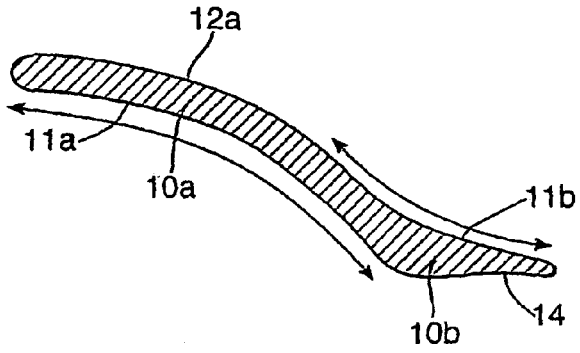
Figure 3A:
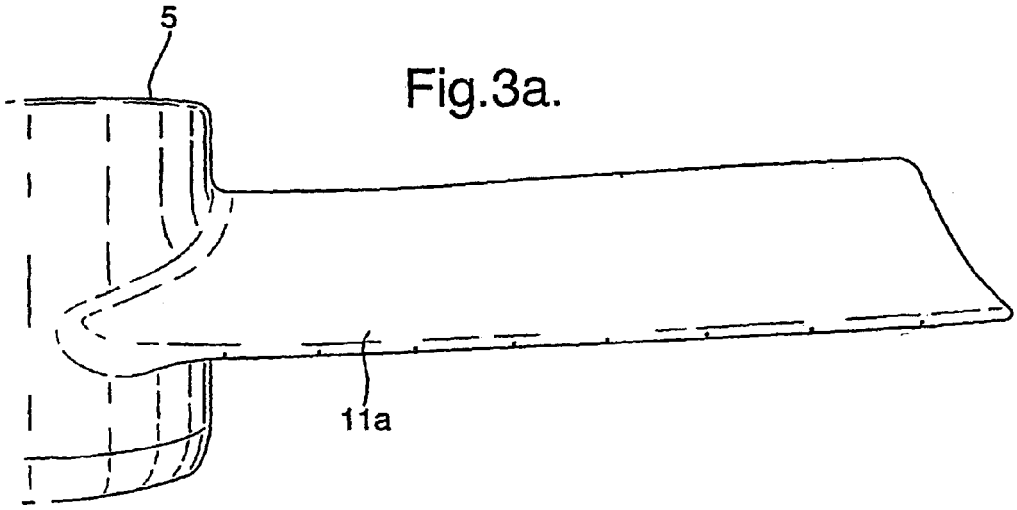
Figure 3B:
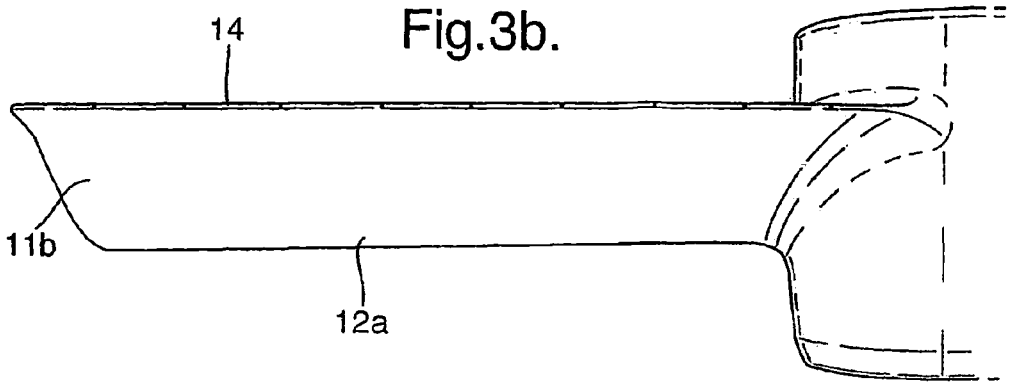
Figure 4:
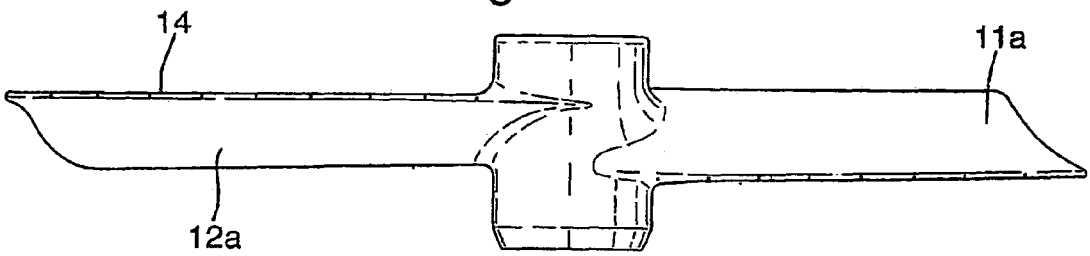
Figure 5:
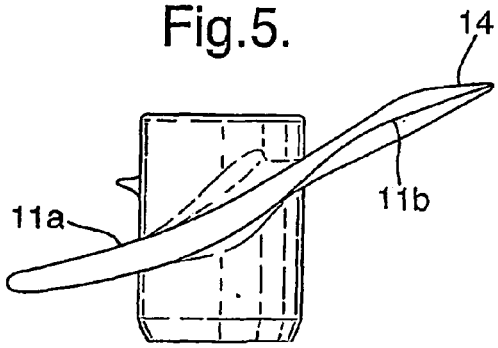
Figure 6:
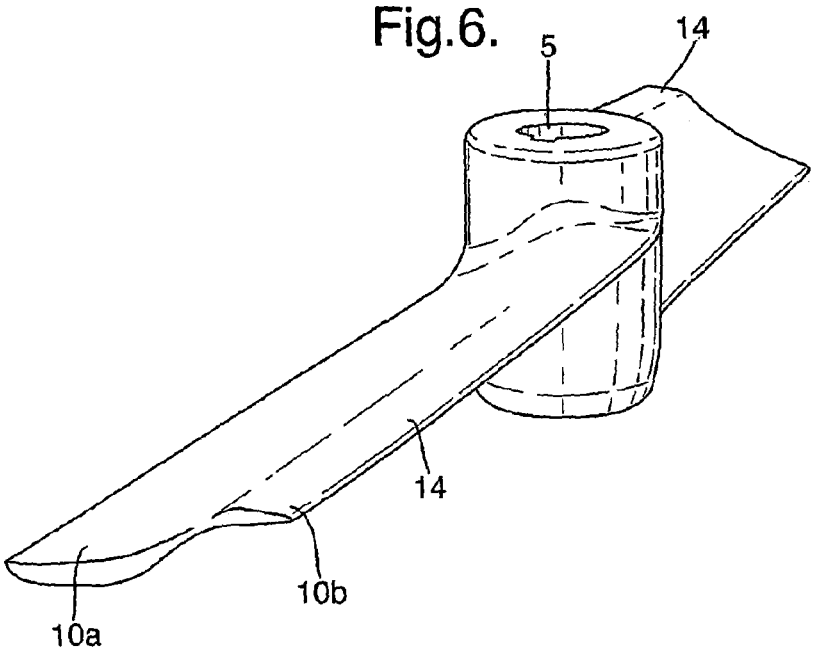
Figure 7:
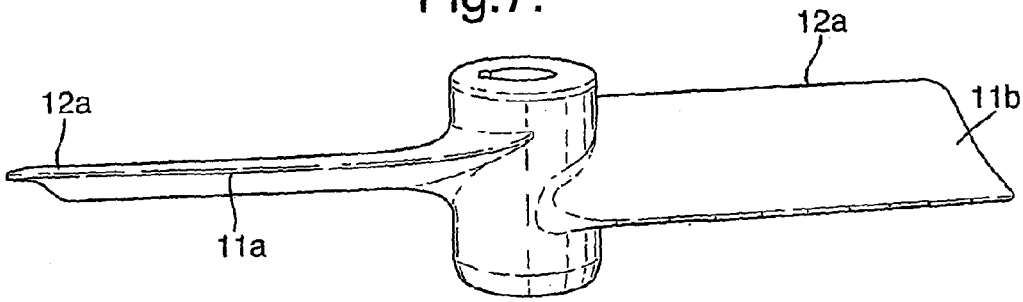
Figure 8:
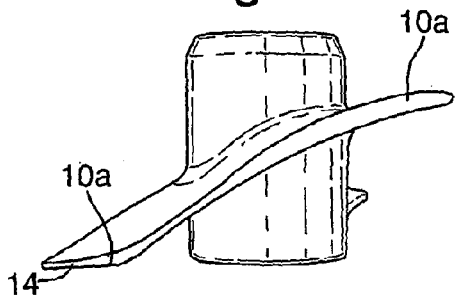
Figure 9:
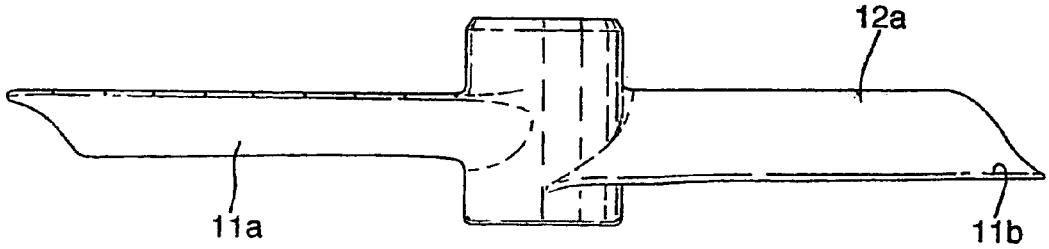
Figure 10:
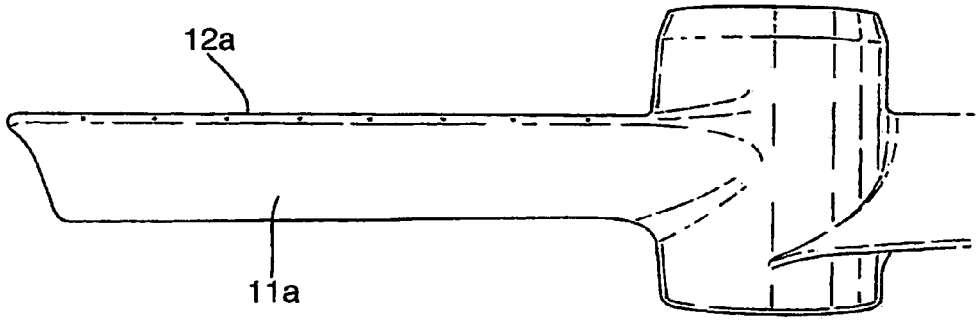
Figure 11:
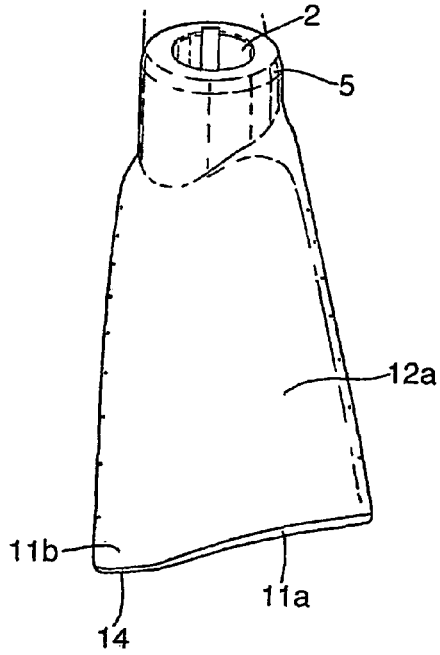
Figure 12:
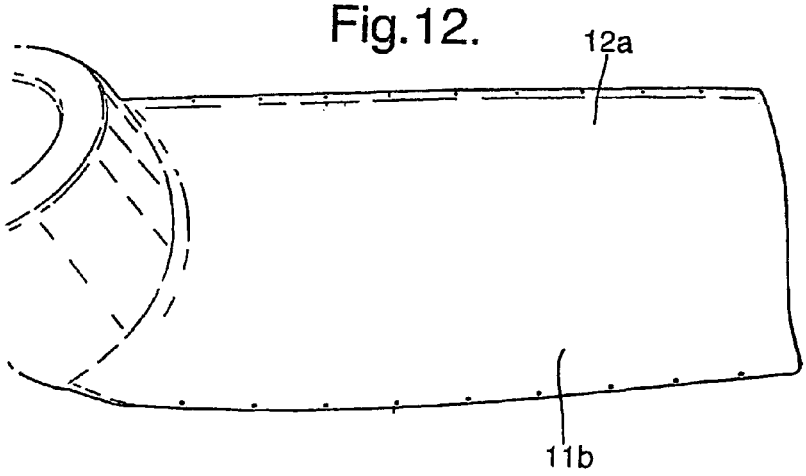
Figure 13:
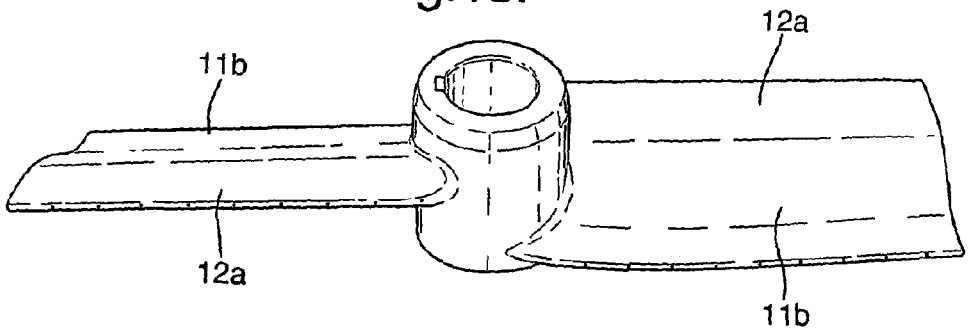
Figure 14:
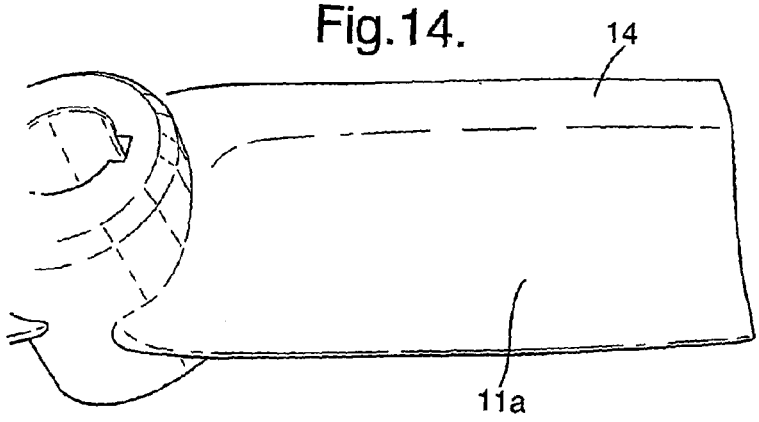
Figure 14A:
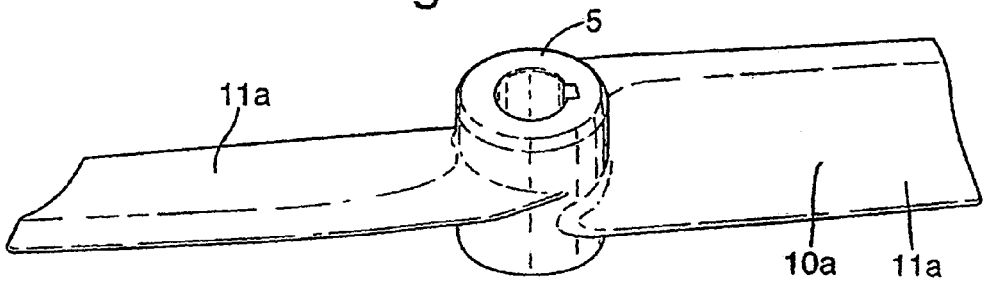
Figure 15:
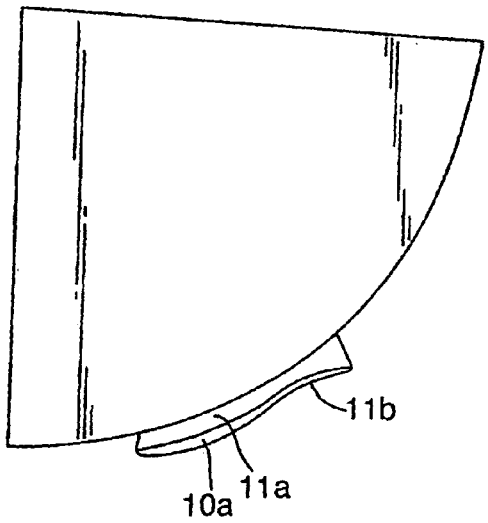
Figure 16:
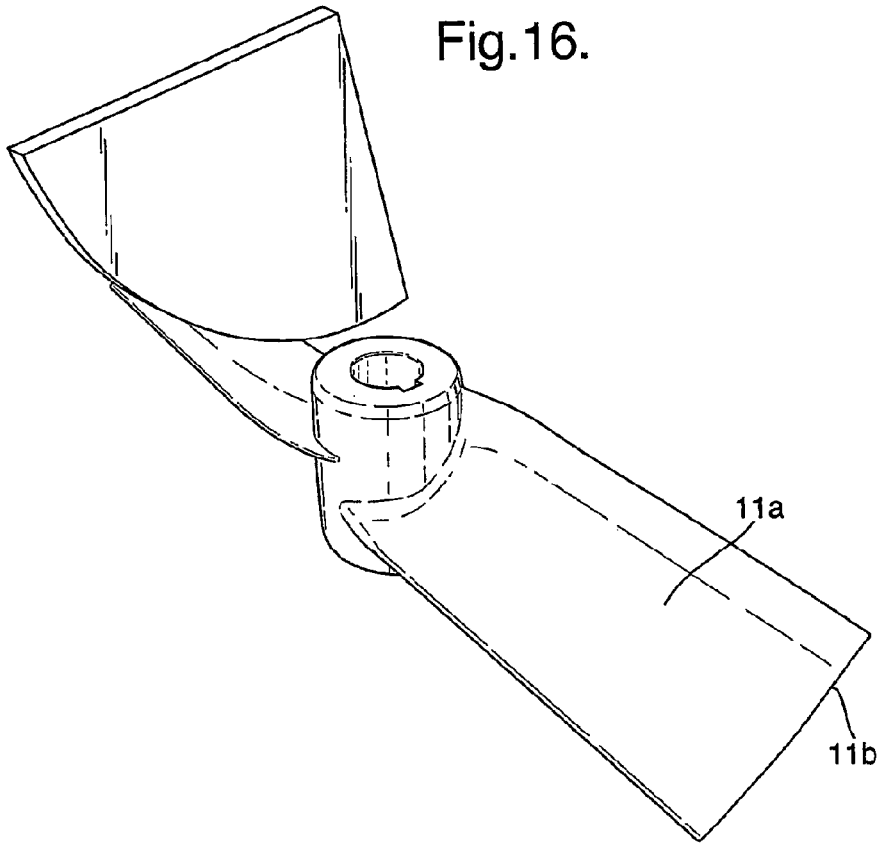
Figure 17:
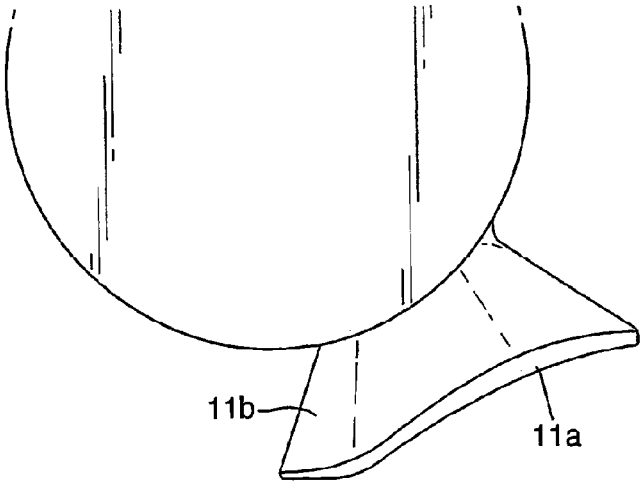
Figure 18:
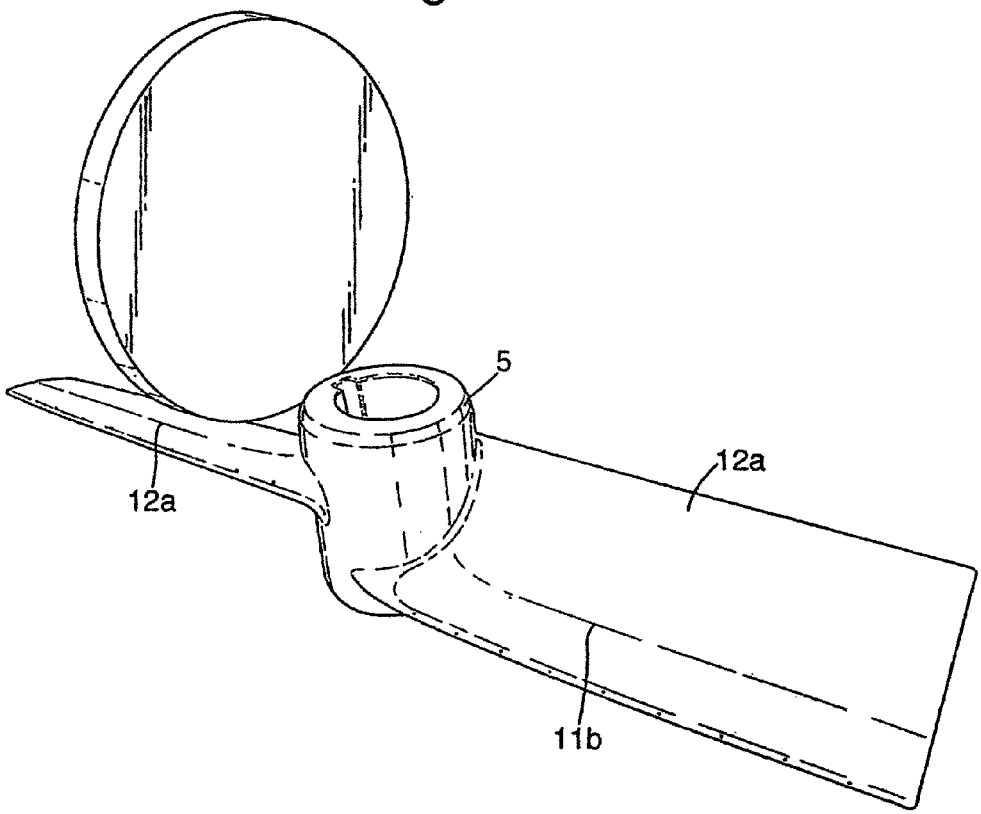

In order that the disclosure may be well understood, there will now be described various forms thereof, given by way of example, reference being made to the accompanying drawing, in which:

FIG. 1*a* is a front view of a propeller according to the teachings of the present disclosure;

FIG. 1*b* is a back view of the propeller of FIG. 1;

FIG. 2 is a cross-sectional illustration of the propeller of FIG. 1;

FIGS. 3*a* and 3*b* are top and bottom views of the propeller of FIG. 1; and FIGS. 4 to 18 are various additional views of the propeller of FIG. 1.

DETAILED DESCRIPTION OF THE INVENTION

The following description is merely exemplary in nature and is not intended to limit the present disclosure, application, or uses.

Referring first to FIG. 1, there is shown a propeller of the disclosure comprising a hub 1 having a pair of blades 3 connected to its outer surface 5. The hub 1 has an axial opening 2 extending therethrough which is configured for non-rotatably mounting the propeller on a suitable shaft such as the propeller shaft of a boat. The non-rotatable coupling may be achieved by forming the surface of the through opening as a conical friction surface which frictionally engages a corresponding surface formed on the propeller shaft, by forming teeth on the surface of the through opening which mate with complementary teeth formed on the propeller shaft, or by other drive coupling means well known to the skilled person, such as by using a keyway 2*a* as shown in FIG. 1.

As best shown in FIG. 1, the hub 1 takes the form of a hollow cylindrical boss so as to provide a straight outer surface 5, with the blades 3 being mounted with their axis perpendicular to the outer surface 5 and hence the axis of the hub 1. However, in an alternative arrangement, the outer surface of the hub may taper as to set a forwards or rearward rake angle on the blades.

Each blade 3 may be attached to the outer surface 5 of the hub 1 in any well known fashion such as by screw thread, welding, casting as a unitary assembly with the hub etc, and may either be rigidly mounted to as to have a fixed pitch or may be rotatably mounted thereon with conventional means being provided to control the pitch angle of the blades.

Referring now to FIG. 2, it can be seen that each blade 3 is of identical construction, being formed of two sections 10*a*, 10*b* which are arranged adjacent to each other, connected together along adjacent longitudinal edges so as to form a general S shaped or sigmoid cross-section. As shown in FIG. 2, the two blade sections 10*a*, 10*b* each have a concave pressure face 11*a*, 11*b*, which face in opposite directions. Each said pressure face 11*a*, 11*b* is defined by an arc which is of constant curvature. However, the radius of curvature of the pressure face 11*a* of the first blade portion 10*a*, is greater than that of the pressure face 11*b* of the second blade portion 10*b* as clearly demonstrated in FIGS. 16 and 17. The rear face 12*a* of the first portion is then shaped so that the first portion 10*a* has a substantially constant thickness, although the thickness varies at the transition to the second portion so as to avoid discontinuities in the surface which might increase cavitation.

As can clearly been seen in FIG. 2, the extend of the arc of first portion 10*a* is greater than that of the second portion—in the illustrated embodiment, the pressure surface of the first portion subtends an arc of approximately 60 degrees whereas that of the second portion subtends an arc of approximately 45 degrees. As a result, the pressure surface of the first portion extends substantially the full height of the blade whereas the pressure surface of the second portion extends only part of the height of the blade—the pressure surface 11*b* of the second portion then merging into the convex back surface 12*a* of the first portion 10*a*, whilst a substantially flat transition surface 14 extends between the end of the pressure surface 11*a* of the first portion 10*a* and the end of the pressure surface 11*b* of the second portion 10*b*.

In the illustrated embodiment, the radius of curvature of each pressure surface 11*a*, 11*b* does not vary along the length of the blade so that each pressure surface is defined by the curved surface of a segment of a circle.

In use the propeller is oriented with the pressure surface 11*a* of the first blade portion 10*a* facing aft of the craft and hence provides forward thrust, whilst the pressure surface 11*b* of the second blade portion 10*b* provides rearward thrust to the craft when the propeller is driven in reverse.

In a variant of the disclosure which is not illustrated, the blade portions are modified so as to taper outwards from the root towards the tip of the blade, the radius of curvature of each pressure surface, at the same time increasing continuously between the root and the tip. This is achieved by forming each blade portion which its pressure surface being defined by the curved surface of a segment of a hollow frusto-conical body in the manner taught in British application 0411155.5.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A propeller comprising a hub (1) having a plurality of blades (3) extending therefrom, each blade (3) having a root, a tip, a first blade portion (10*a*) extending between said root and said tip and a second blade portion (10*b*) extending between said root and said tip adjacent and substantially parallel to said first blade portion (10*a*), said first and second blade portions (10*a*, 10*b*) each having an arcuate concave face (11*a*, 11*b*), the radius of curvature of each concave face (11*a*, 11*b*) being constant between the root and tip of the blade (3) such that each concave face (11*a*, 11*b*) is defined by a curved surface of a segment of a circle between the root and the tip of the blade (3), wherein said concave faces (11*a*, 11*b*) of said first and second portions (10*a*, 10*b*) faces in substantially opposite directions such that, in use, said concave face (11*a*) of said first blade portion (10*a*) faces rearwards and said concave face (11*b*) of the second blade portion (10*b*) faces forwards, wherein said first blade portion (10*a*) is larger than said second blade portion (10*b*) and the radius of curvature of the concave face (11*a*) of said first blade portion (10*a*) is greater than the radius of curvature of the concave face (11*b*) of the second blade portion (10*b*) such that an angle subtended by the concave face (11*a*) of said first blade portion (10*a*) is greater than an angle subtended by the concave face (11*b*) of the second blade portion (10*b*) and such that the concave face (11*a*) of the first blade portion (10*a*) extends a height greater than a height the concave face (11*b*) of the second blade portion (10*b*) extends.

2. The propeller according to claim 1, wherein each blade (3) is untwisted.

3. The propeller according to claim 1, wherein each of said plurality of blades (3) of the propeller are longitudinally aligned with each other on the hub (1).

4. The propeller according to claim 1, wherein the blades (3) are longitudinally offset along the hub (1).

5. The propeller according to claim 1, wherein the face (11*a*) of the first blade portion (10*a*) forms an approximate 60 degree arc whilst the face (11*b*) of the second blade portion (10*b*) forms an approximate 45 degree arc.

6. The propeller according to claim 1, wherein the blades (3) taper outwards from the root towards the tip.

7. A propeller comprising a hub (1) having a plurality of blades (3) extending therefrom, each blade (3) having a root, a tip, a first blade portion (10*a*) extending between said root and said tip and a second blade portion (10*b*) extending between said root and said tip adjacent to said first blade portion (10*a*), said first and second blade portions (10*a*, 10*b*) each having a concave face (11*a*, 11*b*), wherein a radius of curvature of each concave face (11*a*, 11*b*) is constant between the root and tip of the blade (3) such that each concave face (11*a*, 11*b*) is defined by a curved surface of a segment of a circle between the root and the tip of the blade (3), wherein said concave faces (11*a*, 11*b*) of said first and second portions (10*a*, 10*b*) faces in substantially opposite directions such that, in use, said concave face (11*a*) of said first blade portion (10*a*) faces rearwards and said concave face (11*b*) of the second blade portion (10*b*) faces forwards, wherein said first blade portion (10*a*) is larger than said second blade portion (10*b*) and the radius of curvature of the concave face (11*a*) of said first blade portion (10*a*) is greater than the radius of curvature of the concave face (11*b*) of the second blade portion (10*b*) such that an angle subtended by the concave face (11*a*) of said first blade portion (10*a*) is greater than an angle subtended by the concave face (11*b*) of the second blade portion (10*b*) and such that the concave face (11*a*) of the first blade portion (10*a*) extends a height of the blade (3) greater than a height the the concave face (11*b*) of the second blade portion (10*b*) extends.

8. The propeller according to claim 7, wherein each blade (3) is untwisted.

9. The propeller according to claim 7, wherein each of said plurality of blades (3) of the propeller are longitudinally aligned with each other on the hub (1).

10. The propeller according to claim 7, wherein the blades (3) are longitudinally offset along the hub (1).

11. The propeller according to claim 7, wherein the blades (3) taper outwards from the root towards the tip.

12. A propeller having at least two blades (3) extending therefrom, each blade (3) having a root, a tip, a first blade portion (10*a*) extending between said root and said tip and a second blade portion (10*b*) extending between said root and said tip adjacent to said first blade portion (10*a*), said first and second blade portions (10*a*, 10*b*) each having a concave face (11*a*, 11*b*), wherein a radius of curvature of each concave face (11*a*, 11*b*) is constant between the root and tip of the blade (3), wherein said concave faces (11*a*, 11*b*) of said first and second portions (10*a*, 10*b*) faces in substantially opposite directions such that, in use, said concave face (11*a*) of said first blade portion (10*a*) faces rearwards and said concave face (11*b*) of the second blade portion (10*b*) faces forwards, wherein said first blade portion (10*a*) is larger than said second blade portion (10*b*) and the radius of curvature of the concave face (11*a*) of said first blade portion (10*a*) is greater than the radius of curvature of the concave face (11*b*) of the second blade portion (10*b*) such that an angle subtended by the concave face (11*a*) of said first blade portion (10*a*) is greater than an angle subtended by the concave face (11*b*) of the second blade portion (10*b*) and such that the concave face (11*a*) of the first blade portion (10*a*) extends a height greater than a height the concave face (11*b*) of the second blade portion (10*b*) extends.

13. The propeller according to claim 12, wherein each blade (3) is untwisted.

14. The propeller according to claim 12, wherein the blades (3) of the propeller are longitudinally aligned with each other.

15. The propeller according to claim 12, wherein the blades (3) are longitudinally offset with each other.

16. The propeller according to claim 12, wherein the blades (3) taper outwards from the root towards the tip.

* * * * *